US010168044B2

(12) United States Patent
Lawson

(10) Patent No.: US 10,168,044 B2
(45) Date of Patent: Jan. 1, 2019

(54) SMOKE DETECTOR, EMERGENCY LIGHT AND ALTERNATE LIGHT SOURCE SYSTEM

(71) Applicant: Marcia Lawson, Houston, TX (US)

(72) Inventor: Marcia Lawson, Houston, TX (US)

(73) Assignee: Marcia Lawson, Houston, TX (US)

( * ) Notice: Subject to any disclaimer, the term of this patent is extended or adjusted under 35 U.S.C. 154(b) by 0 days.

(21) Appl. No.: 14/633,266

(22) Filed: Feb. 27, 2015

(65) Prior Publication Data

US 2016/0252244 A1 Sep. 1, 2016

(51) Int. Cl.

| | |
|---|---|
| ***F21V 33/00*** | (2006.01) |
| ***F21V 23/04*** | (2006.01) |
| ***G08B 7/06*** | (2006.01) |
| ***G08B 17/00*** | (2006.01) |
| *F21S 9/02* | (2006.01) |
| *F21Y 115/10* | (2016.01) |

(52) U.S. Cl.

CPC ..... *F21V 33/0076* (2013.01); *F21V 23/0442* (2013.01); *G08B 7/06* (2013.01); *G08B 17/00* (2013.01); *F21S 9/02* (2013.01); *F21Y 2115/10* (2016.08)

(58) Field of Classification Search

CPC ..... F21V 33/0076; F21V 23/0442; F21V 23/0457; G08B 17/10; G08B 5/38; G08B 17/00; G08B 7/06; F21S 9/02

See application file for complete search history.

(56) References Cited

U.S. PATENT DOCUMENTS

| | | | | | |
|---|---|---|---|---|---|
| 3,757,511 | A * | 9/1973 | Burgess | G04C 10/02 | 257/E27.128 |
| 4,199,754 | A * | 4/1980 | Johnson | H02J 9/02 | 340/332 |
| 4,305,069 | A * | 12/1981 | Machen | G08B 7/066 | 116/67 R |
| 4,419,658 | A * | 12/1983 | Jarosz | F21V 33/0076 | 340/321 |
| 4,617,561 | A * | 10/1986 | Brown | G08B 17/10 | 200/60 |
| D386,802 | S * | 11/1997 | Kim, II | D10/109.2 | |
| 6,133,839 | A * | 10/2000 | Ellul, Jr. | G08B 7/062 | 340/331 |
| 7,026,768 | B1 * | 4/2006 | Ruiz | G08B 7/066 | 315/185 R |
| 2010/0102960 | A1 * | 4/2010 | Simon | F21V 33/0076 | 340/540 |
| 2014/0145623 | A1 * | 5/2014 | McCullough | H02J 9/02 | 315/159 |

* cited by examiner

*Primary Examiner* — David V Bruce

(57) ABSTRACT

A self-contained smoke alarm detector, emergency light and alternate light source mechanism in one unit.

7 Claims, 2 Drawing Sheets

SMOKE DETECTOR, EMERGENCY LIGHT AND ALTERNATE LIGHT SOURCE SYSTEM

BACKGROUND OF THE INVENTION

Federal law requires that a smoke detector/alert unit be place in specific locations in all residential dwellings to provide warning to occupants in the event that smoke is detected. However, in the event of an electrical outage, occupants of these dwellings are usually not prepared and are given no warning. Residents can purchase an emergency light unit separately; however, this is not typically done. Generators are pricy, costly to operate and could result in fatality if not operated properly.

This unit detailed provides a smoke detector, emergency lighting and a light source in one unit. The unit eliminates the need to purchase separate smoke detector and emergency light units and requires no special electrical wiring since it plugs directly into the current hardwire smoke detector setup. A smoke detector in an existing home can be easily replaced with this unit.

Current smoke detectors/alarm system radiate a loud sound when smoke is detected; however, a hearing impaired person may not necessarily hear the sound. This unit consists of LED lights which pulsate when the sound warning is given so that a hearing impaired person will see the pulsating light and be warned of impending danger.

There still remains a need in the art for a single self contained emergency light and smoke detector system which this unit provides.

SUMMARY OF THE INVENTION

This unit is a fully functional hardwire interconnected home smoke alarm with light source. The unit is long lasting, low maintenance, and self contained.

When the electricity is on and no smoke is detected no sound will be heard and the lights will not be illuminated.

In the event of an electrical outage when no power is detected and no smoke is detected; the emergency lights will be illuminated. The alarm will not sound. When power is restored and detected the lights will go out. The lights can be turned on and off manually by a built in switch on the unit.

In the event that the electricity is on and smoke is detected, the alarm will sound and the lights will pulsate; when smoke is no longer detected the alarm sound will stop and the lights will be turned off.

In the event that the electricity is off and smoke is detected, the alarm will sound and the lights will pulsate; when smoke is no longer detected the alarm sound will stop. When power is restored and detected, the lights will go out. The lights can be turned on and off manually by a built in switch on the unit.

This unit can also be used as a continuous light source in the event of loss of electricity by simply changing out the battery periodically. The on/off switch can be wall mounted for easy access to turn on and off the light easily.

DETAILED DESCRIPTION OF THE INVENTION

Figure 1:
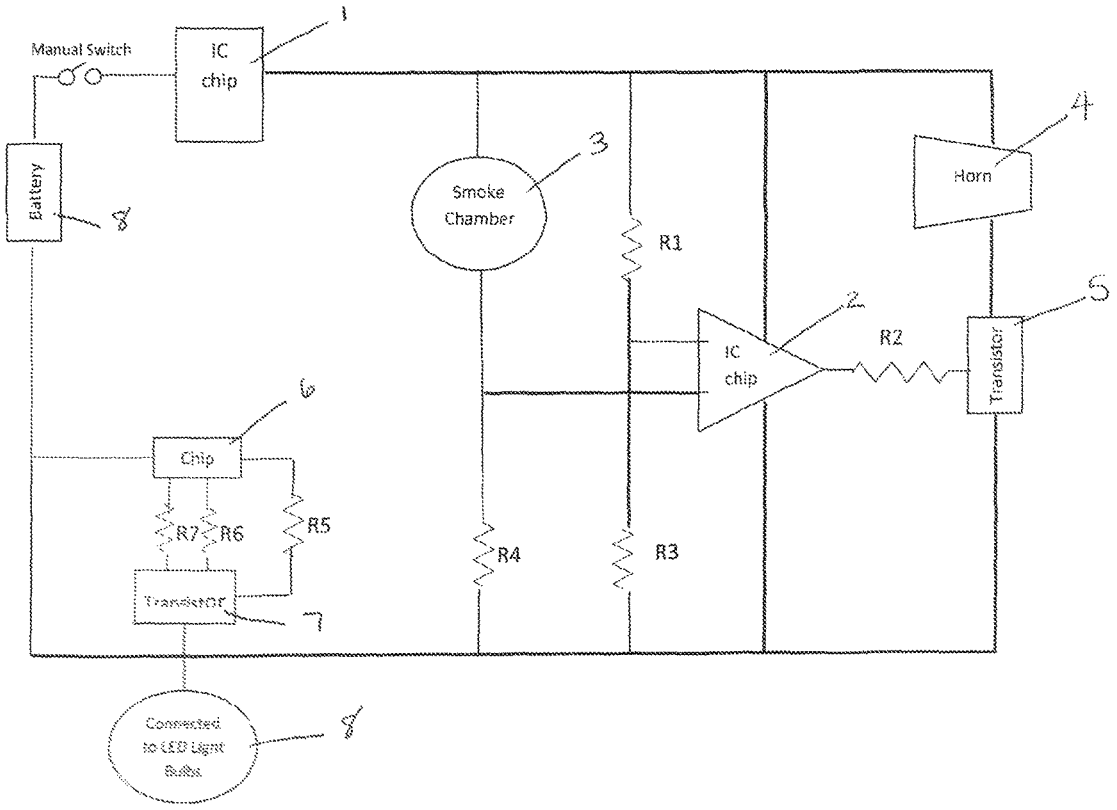
FIG. 1 illustrates the general circuit of the unit

Referring to the drawings; FIG. 1 illustrates a general hardwire smoke detector circuit which includes a smoke chamber 3, integrated chip 2, transistor 5, resistors R1, R2, R3, R4 and a transistor 5 necessary to detect and activate the horn 4 and LED light signals 8. This is further connected to a circuit which consist of chip 6, resistors R5, R6, and R7 and a transistor 7 which are interconnected to at least eight LED lights connected in series. The battery 8 is the source of electricity and can be activated and de-activated automatically or manually via the onboard manual switch controlled by the integrated chip 1.

Figure 2:
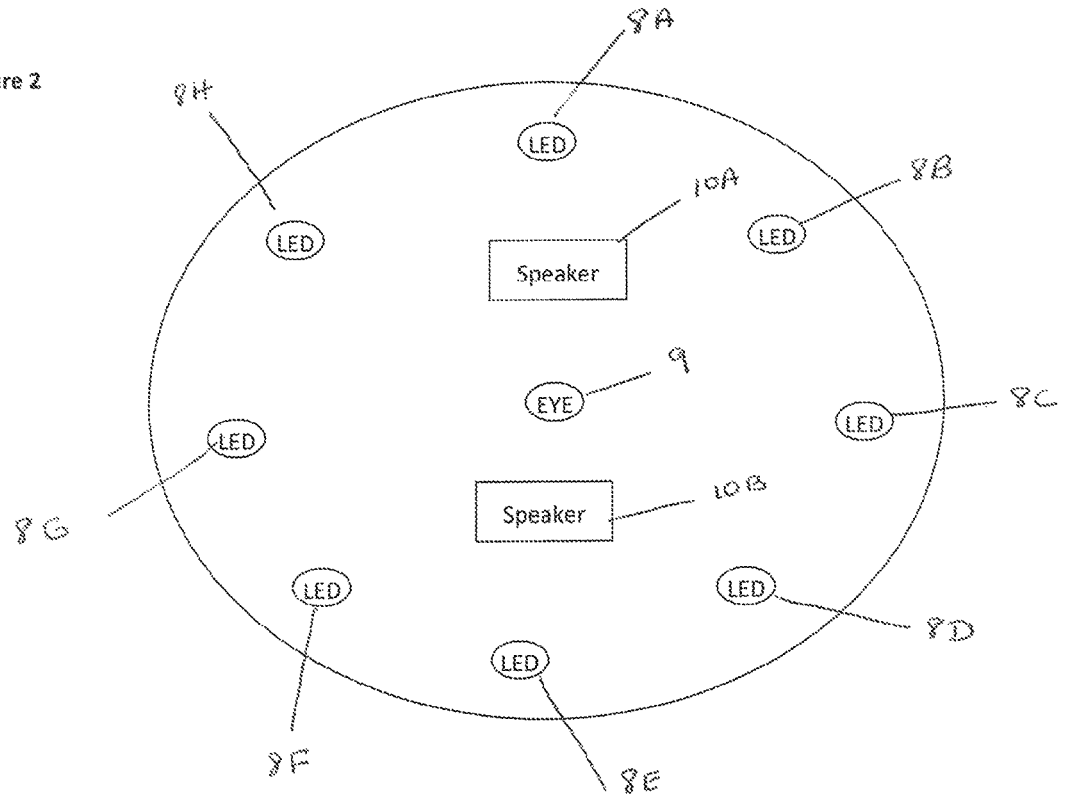
FIG. 2 shows the top view of up to eight LED light bulbs, the photoelectric eye and up to two speakers.

FIG. 2 gives a general layout of the positions of the LEDs 8A through 8G for high impact light coverage. The system is designed to provide light coverage of 360° degrees and provide coverage for a standard size room. The speakers 10A and 10B will provide an audible warning signal. The photoelectric eye 9 is used to help detect the presence of smoke danger and set the warning process in motion.

The LED's will pulsate in the event of an emergency; this will serve as an added layer of warning in addition to the audible warning by the horn. The pulsating light will be a visual warning to hearing impaired occupants.

The battery source will provide the emergency source for electricity as well as function as the backup source for the operation of the smoke alarm detection.

In the absence of danger the LED lights with coverage of 360° degrees can serve as an alternate light source by simply turning the unit on or off by the manual switch on the unit. Light intensity will decrease overtime and will warrant periodic changing of battery unit to maintain intensity.

To be understood the invention is not limited to the illustration shown herein or described above. These are deemed to be merely illustrative of the best modes for carrying out the invention and are susceptible of modification of parts arrangements, sizing, timing, details of operation and technological advancements. The invention is intended to encompass all such modifications which are within the scope of the define claims.

The invention claimed is:

1. An apparatus comprising:

a smoke detector for generating an emergency signal, at least one LED light, a battery, an audible alarm, a switch for manual on/off intervention, and a control circuit connected to the mains electricity, the battery, the at least one LED light, the smoke detector, the audible alarm, and the switch, wherein the components are contained in a single package, and the control circuit is configured to use the battery when the mains electricity isn't available, sound the audible alarm and pulsate the at least one LED light when an emergency signal is received, and light the at least one LED when mains electricity is not available and an emergency signal is not received.

2. The apparatus of claim 1, wherein the control circuit is further operable to control the at least one LED light in a normal mode and an emergency mode in response to an emergency signal.

3. The apparatus of claim 1, further comprising the at least one LED light and smoke detector operable to output an emergency signal, when the control circuit configured to operate the at least one LED light in a normal mode and an emergency mode, in response to the reception of an emergency signal.

4. The apparatus of claim 1, wherein the at least one LED light, the battery, the audible alarm and the smoke detector are contained in one single package.

5. The apparatus of claim 1, further comprising standard sized electrical connectors for compatibility with a standard fixture.

6. The apparatus of claim 1, wherein the at least one LED light will continue to operate for a fixed amount of time after termination of an emergency signal and will the return the at least one LED light to its pre-alarm setting either automatically or by a switch manually.

7. The apparatus of claim 1, wherein the smoke detector is further operable to transmit the emergency signal to another device.

* * * * *